US006170212B1

(12) United States Patent
Suchyna et al.

(10) Patent No.: US 6,170,212 B1
(45) Date of Patent: Jan. 9, 2001

(54) DECK SYSTEM

(75) Inventors: Mark G. Suchyna, Lancaster; Robert G. Kearful, Elma, both of NY (US)

(73) Assignee: CertainTeed Corporation, Valley Forge, PA (US)

( * ) Notice: Under 35 U.S.C. 154(b), the term of this patent shall be extended for 0 days.

(21) Appl. No.: 09/234,596

(22) Filed: Jan. 21, 1999

Related U.S. Application Data

(63) Continuation-in-part of application No. 29/084,031, filed on Feb. 23, 1998.

(51) Int. Cl.[7] ..... F04B 5/48

(52) U.S. Cl. ..... 52/480; 52/177; 52/468; 52/469; 52/471; 52/470

(58) Field of Search ..... 52/177, 181, 465, 52/469, 650.3, 471, 480, 468, 472, 470

(56) References Cited

U.S. PATENT DOCUMENTS

| | | | | |
|---|---|---|---|---|
| D. 329,914 | | 9/1992 | Veilleux . | |
| 2,181,812 | | 11/1939 | Kammerer . | |
| 2,742,121 | | 4/1956 | Liskey, Jr. . | |
| 3,046,852 | | 8/1962 | Graham . | |
| 3,675,385 | | 7/1972 | Chan . | |
| 3,868,802 | * | 3/1975 | Schubach | 52/471 |
| 3,953,661 | * | 4/1976 | Gulley | 428/542 |
| 4,067,155 | * | 1/1978 | Ruff et al. | 52/105 |
| 4,481,747 | * | 11/1984 | Tengesdal et al. | 52/468 X |
| 4,533,278 | * | 8/1985 | Corsover et al. | 404/65 |
| 4,590,110 | | 5/1986 | Arens . | |
| 4,838,000 | | 6/1989 | Ljungkvist . | |
| 4,856,250 | | 8/1989 | Gronau et al. . | |
| 4,936,065 | * | 6/1990 | Hutchinson | 52/235 |
| 5,009,045 | | 4/1991 | Yoder . | |
| 5,048,448 | | 9/1991 | Yoder . | |
| 5,054,253 | | 10/1991 | Bedics . | |
| 5,758,456 | * | 6/1998 | Case | 52/177 |
| 5,806,261 | * | 9/1998 | Huebner et al. | 52/283 |
| 5,904,011 | * | 5/1999 | Biro | 52/177 |
| 5,913,784 | * | 6/1999 | Hite | 52/177 |

OTHER PUBLICATIONS

UltraGuard, The Ultimate Railing & Deck, 4 pages.
Brock Dock, The Ultimate Decking Solution, 8 pages.
The Royal Deck, 4 pages.
Dreamspace Decks, 1995 Thermal Industries, Inc., 6 pages.
P.V.C. Exterior Flooring Systems, PVC Lumber System, 5 pages.
Heritage Fence, Recommendations for Support System, Heritage Vinyl Products. 3 pages.
Technidock, Inc. 1996, 2 pages.
Sheerline Deck System Components, L.B. Plastics, 1 page.
Vecor Flooring System, Vecor Enterprises, Inc., 1 page.
PVC Design, PVC Flooring Systems, 1 page.

* cited by examiner

*Primary Examiner*—Carl D. Friedman
*Assistant Examiner*—Phi Dieu Tran A
(74) *Attorney, Agent, or Firm*—Duane Morris & Heckscher LLP

(57) ABSTRACT

A deck system including cooperating plastic planks, fastener covers and end caps. Each of the plastic planks has at least one channel in the upper surfaces which extends the length of the plank. Each channel includes at least one pair of opposed ledges. Each fastener cover is configured for insertion into one of the channels. The fastener cover is an elongate member having an upper face portion and a pair of legs downwardly depending from the upper face portion and extending substantially the entire length thereof. The fastener cover includes a pair of upper laterally projecting flanges and a pair of lower laterally projecting flanges. When a fastener cover is inserted into a channel, the pairs of upper and lower flanges receive the at least one pair of ledges with a gap sufficient to accommodate displacement of the fastener cover arising from ice expansion in the channel. Such a gap minimizes the likelihood of damage to the fastener cover and/or its expulsion from the channel as a consequence of ice expansion in the channel.

11 Claims, 6 Drawing Sheets

DECK SYSTEM

This application is a continuation-in-part of U.S. patent application Ser. No. 29/084,031 filed Feb. 23, 1998.

FIELD OF THE INVENTION

The present invention relates in general to a deck system and in particular to an improved deck system comprising cooperating plastic planks, fastener covers and end caps.

BACKGROUND OF THE INVENTION

In both new building constructions and renovation projects, there is an increasing demand in the residential, commercial and public building construction industries to provide private homes, businesses such as shops and restaurants, and public park facilities with deck structures. These structures typically comprise joists overlain with planks or floor boards and bound by a plurality of posts. Because of its natural beauty, comparatively low cost and abundant supply, wood has historically been the predominant material of choice in the construction of decks and similar structures, e.g., walkways, steps, and boat decks and piers. However, the lumber used in the construction of such structures requires considerable and costly maintenance to slow its inevitable deterioration caused by continual exposure to the sun, rain, snow and other natural elements. Moreover, wooden decks and related structures are subject to splintering which can be a hazard to individuals in bare feet. And, wooden structures are highly flammable.

For these and other reasons, rigid plastics such as polyvinyl chloride (PVC) have become an increasingly popular alternative to wood in the construction of decks and similar structures. Examples of deck systems fabricated in whole or in part from rigid plastic include those disclosed in U.S. Pat. Nos. 5,048,448, 5,009,045 and Des. 329,914 (which are all expressly incorporated by reference herein), as well as certain systems marketed by PVC Design of Fort Lauderdale, Fla., Thermal Industries, Inc. of Pittsburgh, Pa., Royal Group Technologies Limited of Ontario, Canada, L.B. Plastics, Inc. of Mooresville, N.C., Brock Manufacturing of Milford, Ind., Heritage Vinyl Products of Macon, Miss., Alside, Inc. of Akron, Ohio, PVC Lumber System of Montreal, Canada and Vecor Enterprises Inc. of Chomedey Laval, Canada. Most of these systems comprise extruded plastic, e.g., PVC, decking planks and end caps. According to some of these designs the flooring planks are secured to fastener strips which in turn are secured to the joists. In others, such as the PVC Lumber System and Vecor Enterprises Inc. designs, the decking planks are secured directly to the joists via screws or similar fastening means.

The profiles of the PVC Lumber System and Vecor Enterprises Inc. decking planks include at least one deep channel in the upper surface of and extending longitudinally along the planks. The screws are inserted into the channel and driven therethrough and into the joists to anchor the plank to the joists. Once the screws have been installed, an elongated plastic cover, typically formed from PVC, is inserted into the channel to cover the screw heads and give a finished appearance to the plank. On its substantially vertical side walls the channel is provided with at least one pair of opposed ledges extending the length of the recess. The PVC screw cover has upper and lower flanges which project from both of its longitudinal side edges. The flanges are spaced apart a distance sufficient to closely receive one pair of the opposed ledges, i.e., with a gap of about 0.010 to about 0.020 inch. With such a tight gap the screw cover has little room to move outwardly with respect to the ledges under the influence of expanding ice that may form in the channel. Consequently, the lower flanges of the screw cover are especially susceptible to shear failure. That is, the lower flanges may snap under the potentially great compressive contact force that can arise between the lower flanges and the lower surfaces of the captured ledges as a result of ice expansion in the channel. Such failure may entail costly and time consuming replacement of the screw cover depending upon the extent of the damage. And, even if the screw cover flanges do not break, the screw cover may nevertheless be expelled from the channel and may not be reinserted therein until the channel ice is sufficiently thawed.

SUMMARY OF THE INVENTION

A desire exists, therefore, for a plastic decking system including cooperating plastic planks, fastener covers and end caps wherein the fastener covers are easy to install and resistant to expulsion or damage caused by ice expansion.

Other details and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings wherein.

DETAILED DESCRIPTION OF THE INVENTION

Figure 1:
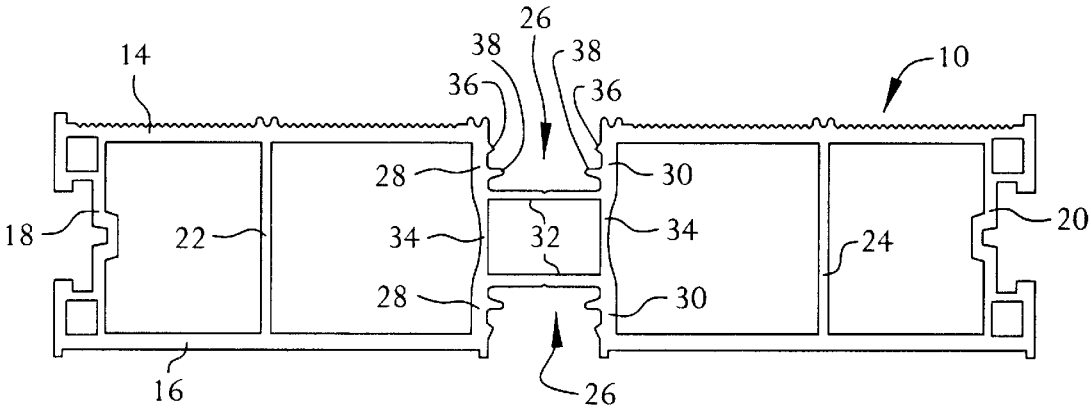
FIG. 1 ( Prior Art )
FIG. 1 is an end elevation view of a conventional plastic decking plank having a longitudinal channel in its upper surface for receiving a fastener cover.
Figure 2:
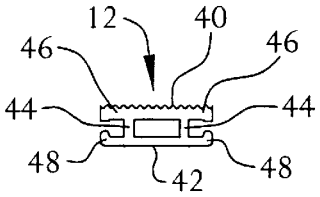
FIG. 2 ( Prior Art )
FIG. 2 is an end elevation view of a conventional plastic fastener cover adapted for insertion into the longitudinal channel provided therefor in the plank of FIG. 1.
Figure 3:
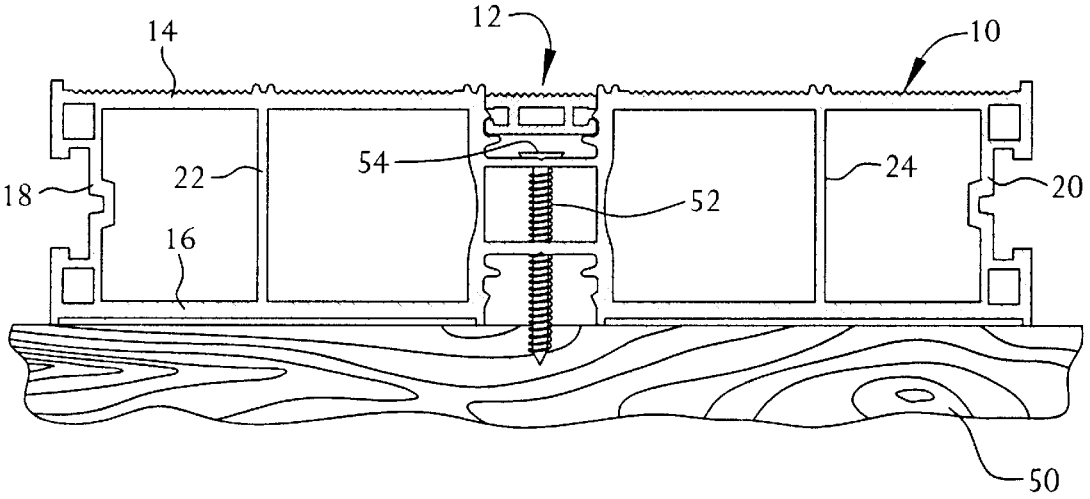
FIG. 3 is an end elevation view of the conventional plastic decking plank and cooperating fastener cover of FIGS. 1 and 2 in assembled condition and attached to a joist member.

Referring to the drawings wherein like references indicate like or similar elements throughout the several figures, there is shown in FIGS. 1, 2 and 3 a conventional plastic flooring or decking plank 10 and fastener cover 12 corresponding generally in structure to those marketed by PVC Lumber System of Montreal, Canada. Both plank 10 and fastener cover 12 may be molded, drawn or extruded from any suitable thermosetting or thermoplastic materials. Typically, however, plank 10 and fastener cover 12 are extruded thermoplastic articles usually fabricated from PVC whose composition may include pigments, thermal stabilizers, impact modifiers, ultra-violet (UV) radiation screening agents and other performance and/or aesthetics enhancing additives.

The plank 10 is a substantially rigid hollow member and includes an upper face portion 14, a lower face portion 16, side walls 18 and 20 and reinforcement braces 22 and 24. The reinforcement braces 22, 24 are joined at their upper and lower ends to the upper and lower face portions 14, 16 and extend the length of the plank 10 to bolster the plank's resistance to compression bending, torsion and other forces encountered during installation and use. At least the upper surface of the upper face portion 14 may be a tread surface normally provided with ridges, grooves or other friction enhancing means to promote sure footing when walking on the plank, especially when the plank is wet. Additionally, at least the upper face portion 14 (or, as illustrated, both the upper and lower face portions) may be interrupted by a deep channel or similar formation 26 which extends the entire length of plank 10. Each channel 26 comprises substantially vertical opposed side walls 28, 30 joined to one another by a base 32. If both an upper and lower channel 26 are present, then the channels are typically joined to one another via at least one web 34 to further stiffen the plank.

The opposed side walls 28, 30 of each channel 26 are provided are, two pairs of opposed ledges 36, 38. When the fastener cover 12 is inserted in the channel 26, as shown in FIG. 3, the deeper pair of ledges 38 functions as support means for the fastener cover 12. FIGS. 2 and 3 depict the construction of the fastener cover 12 and its interrelationship with plank 10. Fastener cover 12 may be an elongate, low profile "double I-beam-shaped" member having upper and lower face portions 40, 42 joined to one another by webs 44. The widths of the upper and lower face portions 40, 42 are greater than the spacing of the webs 44 such that the upper and lower face portions define upper and lower pairs of laterally projecting flanges 46, 48.

As shown in FIG. 3, to install a plank 10 onto a plastic, metal or, as shown, wood joist 50, a screw 52 is first inserted into the upper channel 26. The screw 52 is then driven through the basc 32 of the upper channel 26 as well as the base 26 of the lower channel 26, if present, and into the joist 50 until the screw head 54 comes into abutting contact with the upper channel base 32 to anchor the plank 10 to the joist 50. Once the desired number of screws have been inserted into the parallel joists 50 along the length of plank 10, the fastener cover 12 is inserted into the upper channel 26. Because of its compact and relatively rigid double I-beam-type construction, the fastener cover 12 is more easily inserted into the upper channel 26 by sliding the fastener cover 12 through an end of the plank 10. If space prohibits this mode of insertion, however, the fastener cover 12 may be pounded downwardly into the upper channel 26 via a rubber mallet or similar tool, although such manner of insertion may cause damage to either or both of the plank 10 and fastener cover 12. Once the fastener cover 12 is in place, the upper and lower flanges 46, 48 of the fastener cover straddle the shallower pair of ledges 36 formed in the sidewalls 28 and 30 of upper channel 26.

Upper and lower flanges 46, 48 of the fastener cover 12 are spaced from one another so as to closely receive the ledges 36 with a gap of about 0.010 to about 0.020 inch. With such a tight gap the fastener cover 12 has little room to move outwardly with respect to the ledges 36 under the influence of expanding ice that may form in the upper channel 26. So constructed, the lower flanges 48 of the fastener cover 21 are especially susceptible to shear failure. That is, the lower flanges 48 may snap under the potentially great compressive contact force that can arise between the lower flanges 48 and the lower surfaces of the captured ledges 36 as a result of ice expansion in the upper channel 26. Such failure may entail costly and time consuming replacement of the damaged fastener cover 12. And, even if the lower fastener cover flanges 48 do not break, the fastener cover may nevertheless be expelled from the channel and may not be reinserted therein until the ice in the upper channel 26 is sufficiently thawed.

Figure 4:
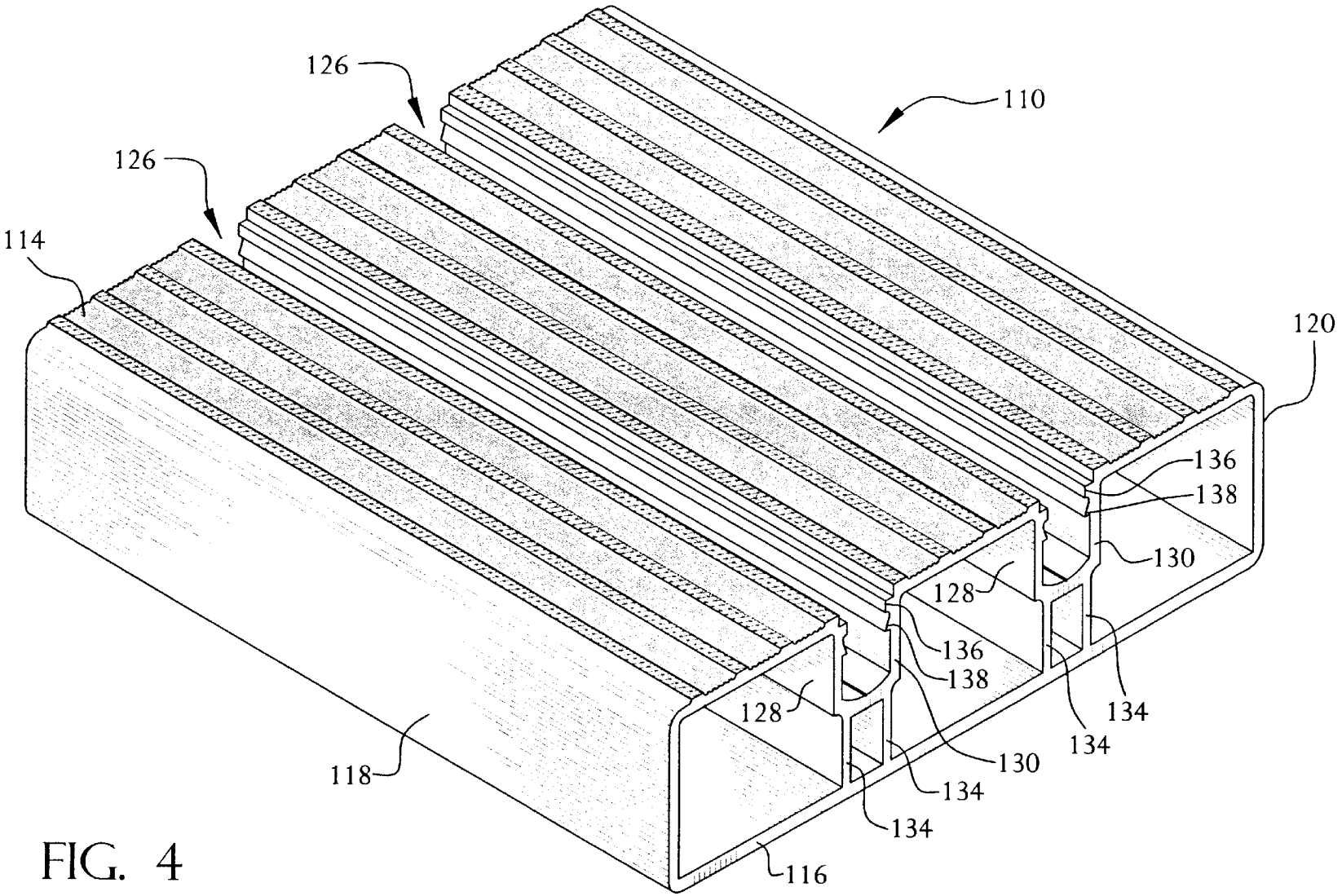
FIG. 4 is a perspective view of the plastic decking plank constructed in accordance with the present invention.
Figure 5:
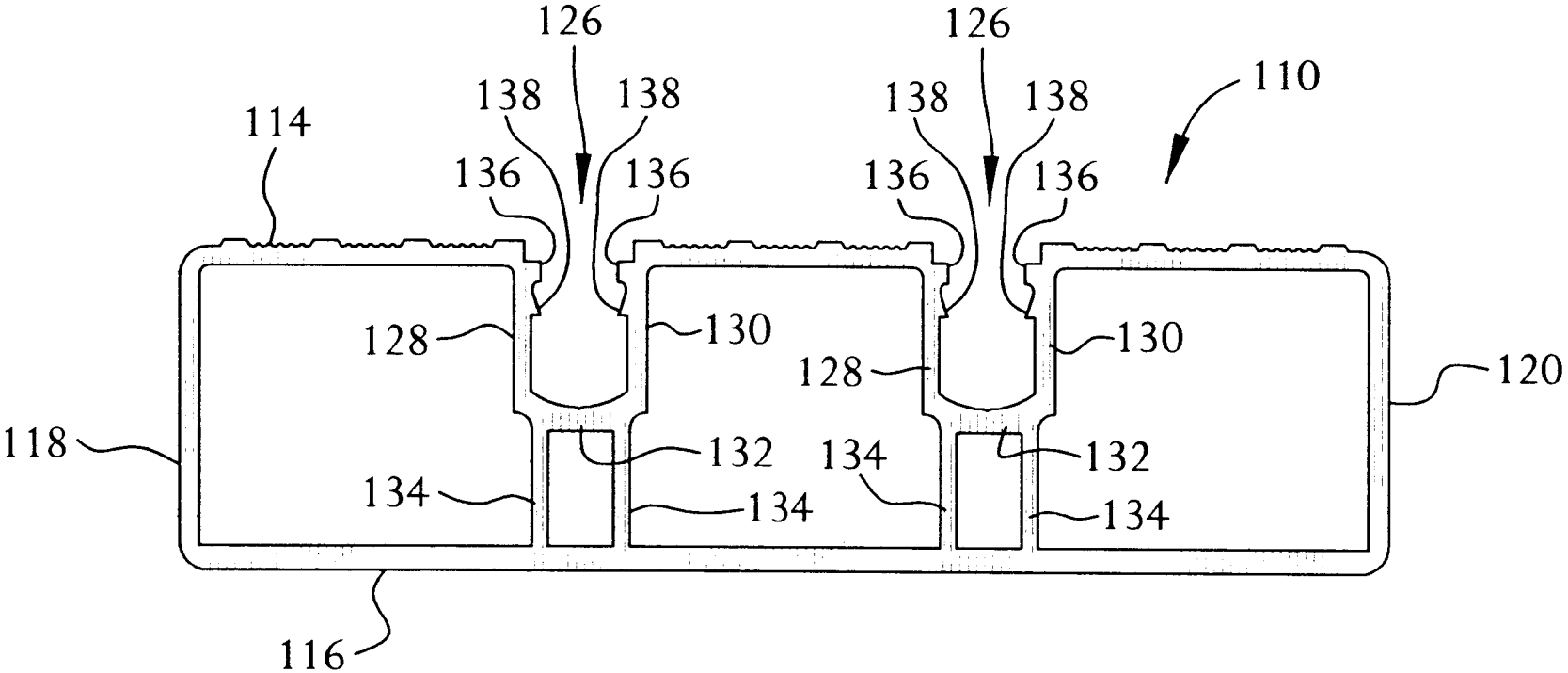
FIG. 5 is an end elevation view of the decking plank of FIG. 4.

FIGS. 4 and 5 reveal a preferred embodiment of a plastic flooring plank constructed in accordance with the present invention. The plank, identified generally by reference numeral 110, comprises a substantially rigid elongate member that is generally rectangular in cross-section. Plank 110 and later described fastener cover 112 (FIGS. 6 and 7) may be molded, drawn or extruded from any suitable thermosetting or thermoplastic materials. Preferably, however, plank 110 and fastener cover 112 are extruded thermoplastic articles fabricated from PVC whose composition may include pigments, thermal stabilizers, impact modifiers, UV radiation screening agents and other performance and/or aesthetics enhancing additives.

To reduce weight and attain the manufacturing, handling and other advantages resulting therefrom, plank 110 is preferably a hollow member and includes an upper face portion 114, a lower face portion 116 and side walls 118 and 120. The upper surface of the upper face portion 114 may be a tread surface provided with ridges, grooves or other friction enhancing means to promote sure footing when walking on the plank, especially when the plank is wet. The upper face portion 114 may be interrupted by at least one or, as illustrated, a plurality of channels 126 which extend the entire length of plank 11. Indeed, according to a presently preferred arrangement, plank 110 may include a pair of channels 126 spaced laterally outwardly from the longitudinal center line of the plank. Such additional channels and their positioning fosters especially secure attachment of the plank to the underlying joist (not shown) via screws or similar fasteners (also not shown).

Additionally, by disposing the channels 126 laterally outwardly from the longitudinal center line of the plank, the plank is less prone to upward curling at its side walls 118, 120 than, for example, a plank constructed in accordance with plank 10, above, which has fastener-receiving channels 26 disposed along the longitudinal center line of the plank. As previously mentioned, screws 52 may be driven through channel 26 of plank 10 to anchor the plank to an underlying joist 50. If screws 52 are over-tightened their heads 54 may exert considerable downward pressure on the upper channel base 30 causing the channel base to be depressed while the lateral sides of the boards become lifted, which lifting is most pronounced at side walls 18 and 20. Spacing the channels 126 of plank 110 of the present invention laterally outwardly from the longitudinal center line of the plank minimizes this problem. Each channel 126 comprises substantially vertical opposed side walls 128, 130 joined to one another by a base 132. At least one or, more preferably, two or more webs 134 join the bases 132 of channels 126 to lower face portion 116 to support the channels and rigidify the plank 110.

The opposed side walls 128, 130 of each channel 26 are preferably provided with at least one or, more preferably, two pairs of opposed ledges 136, 138 the functions of which are described hereinafter.

Figure 6:
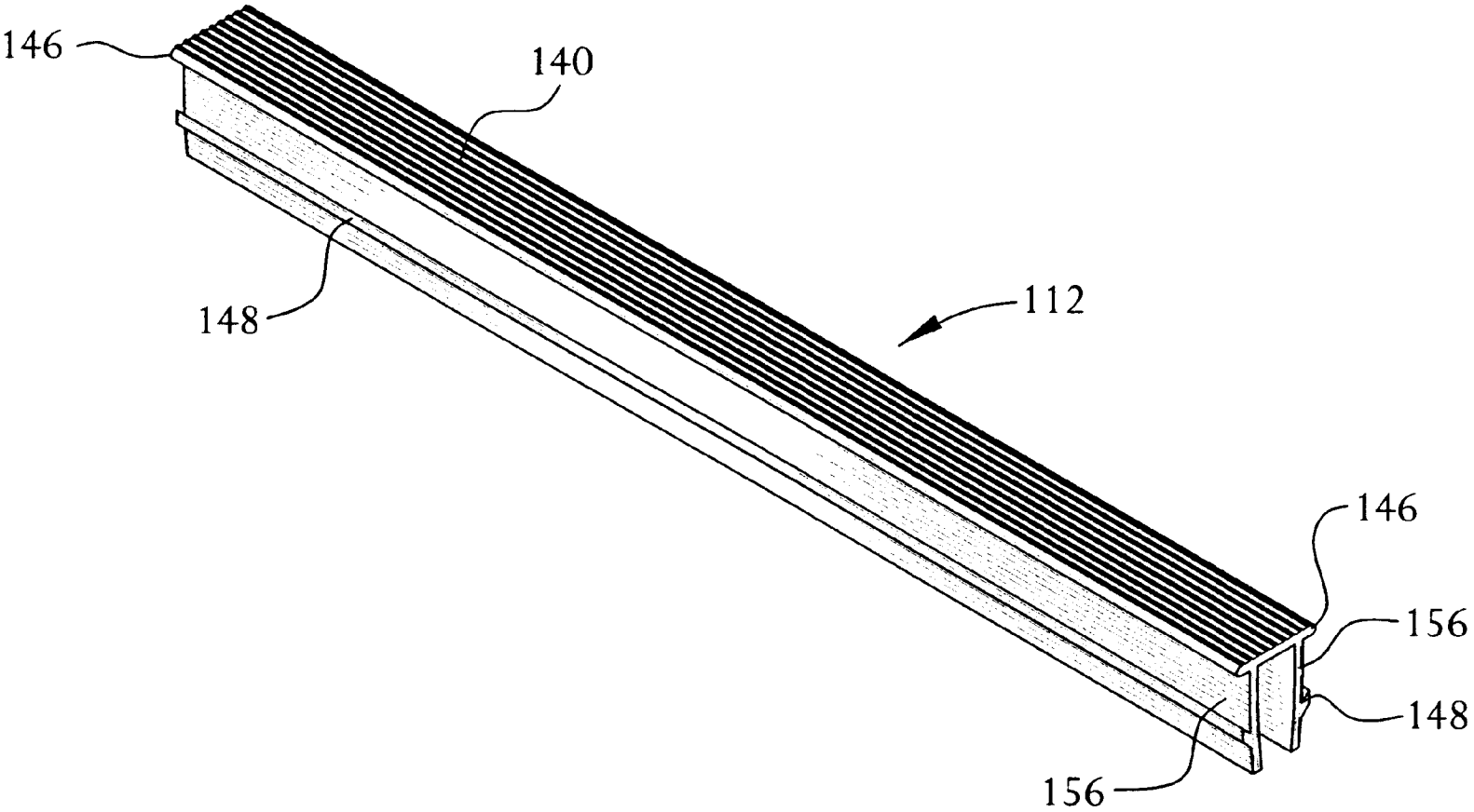
FIG. 6 is a perspective view of the plastic fastener cover constructed according to the present invention and suitable for use with the decking plank of FIG. 4.
Figure 7:
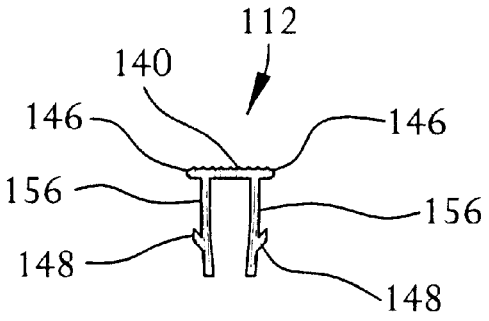
FIG. 7 is an end elevation view of the fastener cover of FIG. 6.

FIGS. 6 and 7 show a presently preferred embodiment of fastener cover 112 suitable for use with plank 110. The fastener cover 112 may be an elongate, inverted substantially "U-shape" member having an upper face portion 140 and a pair of spaced-apart legs 156 downwardly depending from the upper face portion and preferably extending substantially the entire length thereof. Upper face portion 140 may be a tread surface, desirably including ridges, grooves or other traction enhancing means. The width of the upper face portion 140 may be greater than the spacing of the legs 156 such that the upper face portion defines a pair of upper laterally projecting flanges 146. Substantially at or near the lower distal or ends of legs 156 is a pair of laterally, and preferably upwardly, projecting lower flanges 148. An upward slope may be preferred for at least the lower surface of the lower flanges 148 to facilitate insertion of the fastener cover 112 past the ledges 136, 138 of channel 126.

To install a plank 110 onto a plastic, metal or wood joist (not shown), unillustrated screws similar to screw 50 are first inserted into the channels 126. The screws are then driven through the bases 132 of the channels 126 as well as the lower face portion 116 and into the joist until the screws' heads come into abutting contact with the channel bases 132 to anchor the plank 110 to the joist. Once the desired number of screws have been inserted into the parallel joists along the length of plank 11, fastener covers 112 are inserted into the channels 126. Because lower or distal ends of legs 156 are not connected to one another, they are capable of yielding inwardly toward one another during insertion of the fastener covers 112 into the channels 126. Consequently, fastener covers 112 may be easily inserted into channels 126 with moderate finger pressure. They do not need to be slid into the ends of the plank 110 or pounded therein in the manner of fastener cover 12 with respect to plank 10 discussed above. Upon seating of fastener cover 112 in channel 126, legs 156 return to their relaxed state whereby lower flanges 148 are disposed beneath lower ledges 138.

Figure 8:
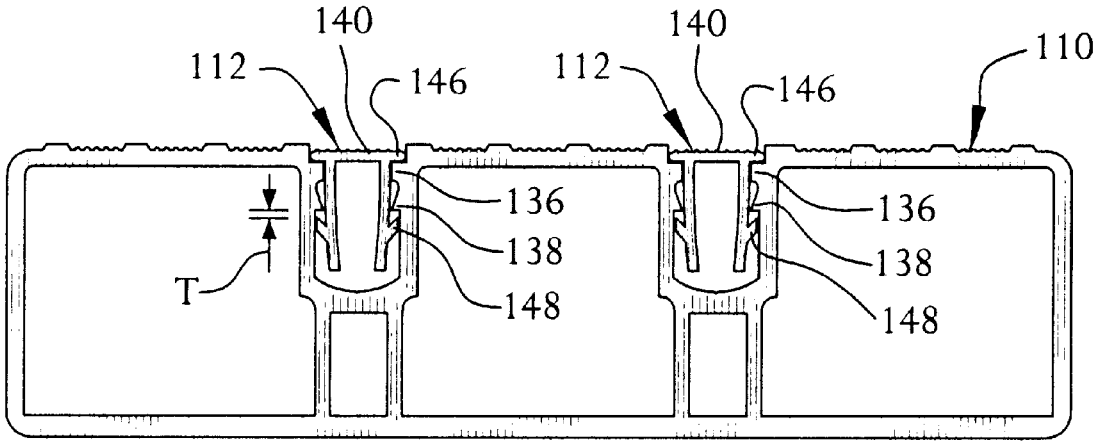
FIG. 8 is an end elevation view of the decking plank and fastener cover according to the present invention in assembled condition.

As shown in FIG. 8, when the fastener covers 112 are engaged with plank 110, the upper and lower flanges 146, 148 of the fastener covers straddle both the upper and lower pairs of ledges 136, 138 of the channels 126 with the lower surfaces of the upper flanges 146 resting atop the upper surfaces of the upper ledges 136. Unlike the flanges 46, 48 of fastener cover 12, which, when installed in plank 10 closely receive ledges 36 with a gap of about 0.010 to about 0.020 inch, the upper and lower flanges 146, 148 loosely receive ledges 136, 138 with a gap "T" of preferably at least about 1/16(0.0625) inch. The present inventors have determined that such a gap affords the fastener cover 112 ample room to move outwardly with respect to the ledges 136, 138 under the influence of expanding ice that may form in the channels 126. Consequently, the likelihood of damage to fastener cover 112 or its expulsion from channel 126 as a result of ice expansion is minimal, thereby correspondingly minimizing the cost and labor associated with maintaining the deck system. It will be appreciated that the upper and lower pairs of ledges 136, 138 of channel 126 may also be formed as a single pair of opposed ledges so long as an appropriate gap "T" is maintained between the edges and the upper and lower flanges 146, 148 of the fastener cover 112.

Figure 9:
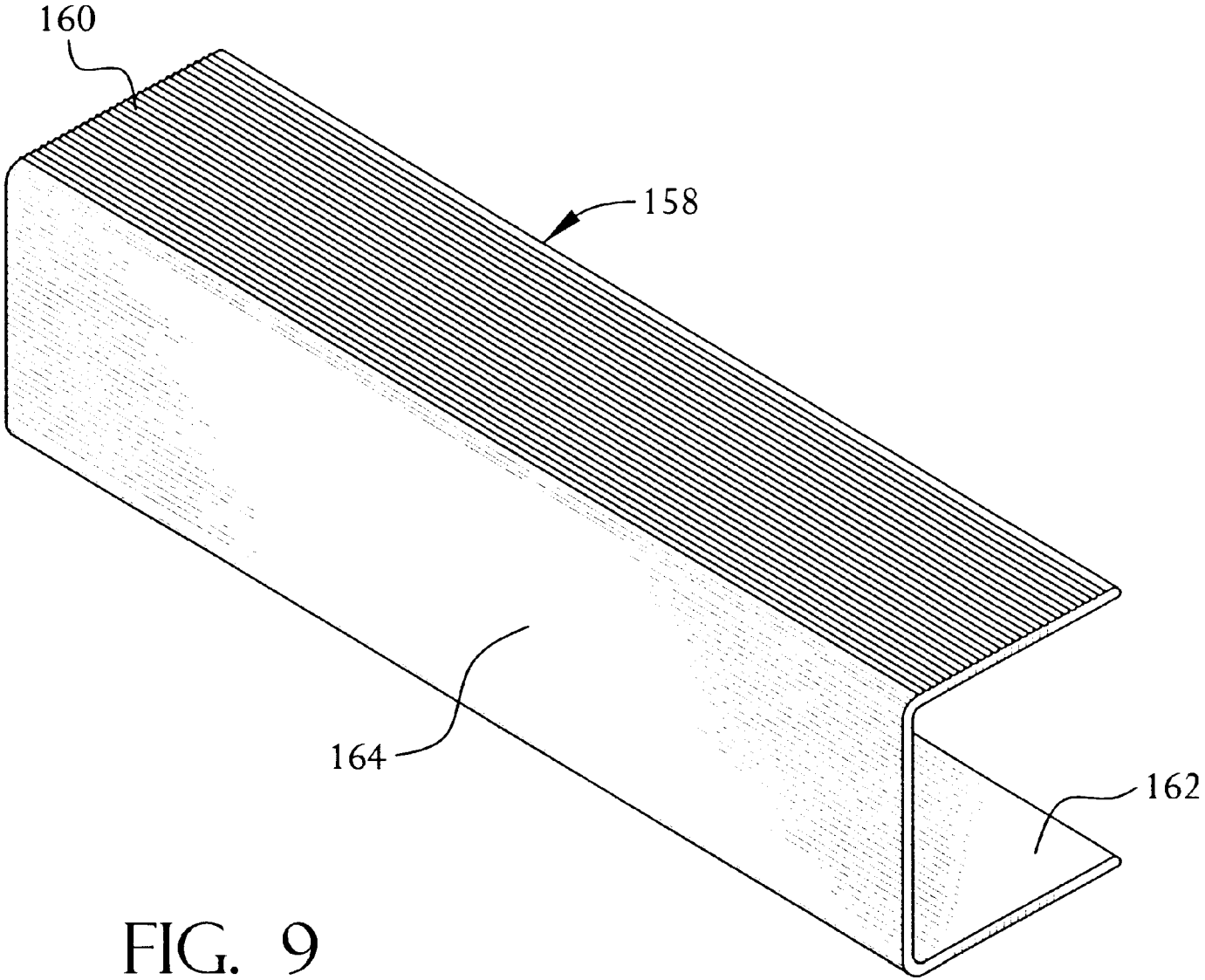
FIG. 9 is a perspective view of a plastic end cap suitable for use with the decking plank of the present invention.

FIG. 9 illustrates a presently preferred construction of an end cap 158 of the plastic deck system of the present invention. Like plank 110 and fastener cover 112, end cap 158 may be made from any suitable thermosetting or thermoplastic materials although extruded PVC, desirably including performance and/or aesthetics enhancing additives, it preferred. End cap 158 may be a generally "C-shaped" channel member having an upper face portion 160 and a lower face portion 162 joined by a web 164. The upper face portion 160 preferably includes grooves, ridges or other traction enhancing means.

The length of end cap 158 is preferably substantially the same as the width of plank 110 (shown in dashed line in FIG. 9). And, the spacing of the upper and lower face portions 160, 162 is such that, when the end cap 158 is slid over the end of the plank 110, the upper and lower face portions 160, 162 grippingly engage the upper and lower surfaces of the plank 110. End cap 158 thus provides a clean, finished appearance to the ends of plank 110 and fastener covers 112.

Although the invention has been described in terms of exemplary embodiments, it is not limited thereto. Rather, the appended claim should be construed broadly, to include other variants and embodiments of the invention which may be made by those skilled in the art without departing from the scope and range of equivalents of the invention.

What is claimed is:

1. A deck system comprising:

an elongate, substantially rigid plank having an upper face portion, a lower face portion and side walls connecting said upper and lower face portions;

a pair of channels provided in said upper face portion and extending the length of said plank, said channels having opposed side walls joined by a base, said channel side walls being provided with at least one pair of opposed ledges; and at least one elongate fastener cover configured for insertion into at least one of said pair of channels, said fastener cover including a pair of laterally projecting upper flanges and a pair of laterally projecting lower flanges, whereby, when said at least one fastener cover is inserted into said pair of channels, said pairs of upper and lower flanges loosely receive said pair of ledges with a gap sufficient to accommodate displacement of said fastener cover arising from ice expansion in said channels.

2. The deck system of claim 1 wherein said gap is at least about 1/16 inch.

3. The deck system of claim 1 wherein said at least one fastener cover comprises a pair of fastener covers.

4. The deck system of claim 1 wherein said at least one pair of opposed ledges comprise a pair of upper ledges and a pair of lower ledges.

5. The deck system of claim 4 wherein said pair of upper flanges is configured for disposition above said pair of upper ledges and said pair of lower flanges is configured for disposition beneath said pair of lower ledges.

6. The deck system of claim 1 wherein said fastener cover comprises an upper face portion and a pair of spaced-apart legs, said legs downwardly depending from said upper face portion of said fastener cover and extending substantially the entire length thereof.

7. The deck system of claim 6 wherein said pair of upper flanges comprise lateral extensions of said upper face portion of said fastener cover, and wherein one of said pair of lower flanges projects laterally outwardly from each of said legs substantially near the distal end thereof.

8. The deck system of claim 7 wherein said pair of lower flanges have upwardly sloped lower surfaces to facilitate insertion of said at least one fastener cover into said at least one channel.

9. The deck system of claim 1 wherein said plank is hollow.

10. The deck system of claim 1 wherein said plank and said fastener cover are fabricated from plastic material.

11. The deck system of claim 10 wherein said plastic material comprises polyvinyl chloride.

* * * * *